US007770646B2

(12) United States Patent
Klassen et al.

(10) Patent No.: US 7,770,646 B2
(45) Date of Patent: Aug. 10, 2010

(54) SYSTEM, METHOD AND APPARATUS FOR HYDROGEN-OXYGEN BURNER IN DOWNHOLE STEAM GENERATOR

(75) Inventors: Michael Klassen, Columbia, MD (US); Ponnuthurai Gokulakrishnan, Columbia, MD (US); Casey Fuller, Columbia, MD (US); Andrew Hamer, Columbia, MD (US); Charles H. Ware, Palm Harbor, FL (US); John E. Langdon, Fort Worth, TX (US)

(73) Assignee: World Energy Systems, Inc., Fort Worth, TX (US)

( * ) Notice: Subject to any disclaimer, the term of this patent is extended or adjusted under 35 U.S.C. 154(b) by 0 days.

(21) Appl. No.: 11/868,707

(22) Filed: Oct. 8, 2007

(65) Prior Publication Data

US 2008/0083537 A1 Apr. 10, 2008

Related U.S. Application Data

(60) Provisional application No. 60/850,181, filed on Oct. 9, 2006, provisional application No. 60/857,073, filed on Nov. 6, 2006, provisional application No. 60/885,442, filed on Jan. 18, 2007.

(51) Int. Cl.
*E21B 36/00* (2006.01)
*E21B 43/24* (2006.01)

(52) U.S. Cl. ..... 166/303; 166/59

(58) Field of Classification Search ..... 166/59, 166/256, 57, 302, 303; 431/350; 122/5.52; 60/39.57

See application file for complete search history.

(56) References Cited

U.S. PATENT DOCUMENTS 3,456,721 A * 7/1969 Smith ..... 166/59

(Continued)

FOREIGN PATENT DOCUMENTS

CA 2335737 12/1999

(Continued)

OTHER PUBLICATIONS

PCT Search Report, International Application No. PCT/US2007/021530, Dated Mar. 25, 2008.

(Continued)

*Primary Examiner*—Jennifer H Gay
*Assistant Examiner*—Angela M DiTrani
(74) *Attorney, Agent, or Firm*—Patterson & Sheridan, LLP

(57) ABSTRACT

A downhole burner for a steam generator includes an injector and a cooling liner. Steam enters the burner through holes in the cooling liner. Combustion occurring within the cooling liner heats the steam and increases its quality and may superheat it. The heated, high-quality steam and combustion products exit the burner and enter an oil-bearing formation to upgrade and improve the mobility of heavy crude oils held in the formation. The injector includes a face plate, a cover plate, an oxidizer distribution manifold plate, and a fuel distribution manifold plate. The cooling liner has an effusion cooling section and effusion cooling and jet mixing section. The effusion cooling section includes effusion holes for injecting steam along the cooling liner surface to protect the liner. The effusion cooling and jet mixing section has both effusion holes and mixing holes for injecting steam further toward central portions of the burner.

50 Claims, 6 Drawing Sheets

U.S. PATENT DOCUMENTS

| | | | | | |
|---|---|---|---|---|---|
| 3,980,137 | A | * | 9/1976 | Gray | 166/256 |
| 3,982,591 | A | | 9/1976 | Hamrick et al. | |
| 3,982,592 | A | | 9/1976 | Hamrick et al. | |
| 4,024,912 | A | | 5/1977 | Hamrick et al. | |
| 4,050,515 | A | | 9/1977 | Hamrick et al. | |
| 4,053,015 | A | | 10/1977 | Hamrick et al. | |
| 4,077,469 | A | | 3/1978 | Hamrick et al. | |
| 4,078,613 | A | | 3/1978 | Hamrick et al. | |
| 4,159,743 | A | | 7/1979 | Rose et al. | |
| 4,199,024 | A | | 4/1980 | Rose et al. | |
| 4,336,839 | A | | 6/1982 | Wagner et al. | |
| 4,366,860 | A | | 1/1983 | Donaldson et al. | |
| 4,380,267 | A | * | 4/1983 | Fox | 166/303 |
| 4,385,661 | A | | 5/1983 | Fox | |
| 4,411,618 | A | | 10/1983 | Donaldson et al. | |
| 4,442,898 | A | | 4/1984 | Wyatt | |
| 4,456,068 | A | * | 6/1984 | Burrill et al. | 166/266 |
| 4,463,803 | A | | 8/1984 | Wyatt | |
| 4,475,883 | A | | 10/1984 | Schirmer et al. | |
| 4,558,743 | A | | 12/1985 | Ryan et al. | |
| 4,597,441 | A | * | 7/1986 | Ware et al. | 166/261 |
| 4,648,835 | A | | 3/1987 | Eisenhawer et al. | |
| 4,691,771 | A | | 9/1987 | Ware et al. | |
| 4,706,751 | A | | 11/1987 | Gondouin | |
| 4,861,263 | A | | 8/1989 | Schirmer | |
| 4,930,454 | A | | 6/1990 | Latty et al. | |
| 5,055,030 | A | | 10/1991 | Schirmer | |
| 5,163,511 | A | | 11/1992 | Amundson et al. | |
| 5,255,742 | A | | 10/1993 | Mikus | |
| 5,404,952 | A | | 4/1995 | Vinegar et al. | |
| 5,488,990 | A | | 2/1996 | Wadleigh et al. | |
| 5,623,576 | A | | 4/1997 | Deans | |
| 5,832,999 | A | | 11/1998 | Ellwood | |
| 5,862,858 | A | | 1/1999 | Wellington et al. | |
| 5,899,269 | A | | 5/1999 | Wellington et al. | |
| 6,016,867 | A | | 1/2000 | Gregoli et al. | |
| 6,016,868 | A | | 1/2000 | Gregoli et al. | |
| 6,019,172 | A | | 2/2000 | Wellington et al. | |
| 6,269,882 | B1 | | 8/2001 | Wellington et al. | |
| 6,328,104 | B1 | | 12/2001 | Graue | |
| 6,358,040 | B1 | | 3/2002 | Pfefferle et al. | |
| 6,394,791 | B2 | | 5/2002 | Smith et al. | |
| 6,752,623 | B2 | | 6/2004 | Smith et al. | |
| 6,973,968 | B2 | | 12/2005 | Pfefferle | |
| 7,114,566 | B2 | | 10/2006 | Vinegar et al. | |
| 7,343,971 | B2 | | 3/2008 | Pfefferle | |
| 7,497,253 | B2 | | 3/2009 | Retallick et al. | |
| 2005/0239661 | A1 | | 10/2005 | Pfefferle | |
| 2006/0142149 | A1 | | 6/2006 | Ma et al. | |
| 2006/0162923 | A1 | | 7/2006 | Ware | |
| 2006/0254956 | A1 | | 11/2006 | Khan | |
| 2007/0193748 | A1 | | 8/2007 | Ware et al. | |
| 2007/0235187 | A1 | * | 10/2007 | Goodman | 166/259 |

FOREIGN PATENT DOCUMENTS

| | | |
|---|---|---|
| CA | 2335771 | 12/1999 |
| CA | 2363909 | 5/2003 |
| CA | 2335771 | 11/2003 |
| VE | 59502 | 11/2001 |
| VE | 120499 | 11/2001 |
| VE | 2001-002508 | 12/2003 |
| VE | 2001002508 | 12/2003 |
| WO | WO 2007/098100 | 8/2007 |

OTHER PUBLICATIONS

Comparative Analysis of Stem Delivery Cost for Surface and Downhole Steam Drive Technologies, Sandia national Labs., Albuquerque, NM, Oct. 1981, National Technical Information Services.

Downhole Steam-Generator Study, vol. 1, Conception and Feasibility Evaluation, Final Report, Sep. 1978-Sep. 1980, Sandia National Labs., Albuquerque, NM, Jun. 1982.

International Search Report and Written Opinion for International Application No. PCT/US 08/51496 dated Nov. 6, 2008.

Robert M. Schirmer and Rod L. Eson, A Direct-Fired Downhole Steam Generator—From Design to Field Test, Society of Petroleum Engineers, Oct. 1985, pp. 1903-1908.

* cited by examiner

SYSTEM, METHOD AND APPARATUS FOR HYDROGEN-OXYGEN BURNER IN DOWNHOLE STEAM GENERATOR

This non-provisional patent application claims priority to and the benefit of U.S. Provisional Patent App. Nos. 60/850,181, filed Oct. 9, 2006; 60/857,073, filed Nov. 6, 2006; and 60/885,442, filed Jan. 18, 2007.

BACKGROUND OF THE INVENTION

1. Technical Field

The present invention relates in general to steam generators used downhole in wells and, in particular, to an improved system, method, and apparatus for a burner for a downhole steam generator.

2. Description of the Related Art

There are extensive viscous hydrocarbon reservoirs throughout the world. These reservoirs contain a very viscous hydrocarbon, often called "tar," "heavy oil," or "ultra heavy oil," which typically has viscosities in the range from 3,000 to 1,000,000 centipoise when measured at 100 degrees F. The high viscosity males it difficult and expensive to recover the hydrocarbon. Strip mining is employed for shallow tar sands. For deeper reservoirs, heating the heavy oil in situ to lower the viscosity has been employed.

In one technique, partially-saturated steam is injected into a well from a steam generator at the surface. The heavy oil can be produced from the same well in which the steam is injected by allowing the reservoir to soak for a selected time after the steam injection, then producing the well. When production declines, the operator repeats the process. A downhole pump may be required to pump the heated heavy oil to the surface. If so, the pump has to be pulled from the well each time before the steam is injected, then re-run after the injection. The heavy oil can also be produced by means of a second well spaced apart from the injector well.

Another technique uses two horizontal wells, one a few feet above and parallel to the other. Each well has a slotted liner. Steam is injected continuously into the upper well bore to heat the heavy oil and cause it to flow into the lower well bore. Other proposals involve injecting steam continuously into vertical injection wells surrounded by vertical producing wells.

U.S. Pat. No. 6,016,867 discloses the use of one or more injection and production boreholes. A mixture of reducing gases, oxidizing gases, and steam is fed to downhole-combustion devices located in the injection boreholes. Combustion of the reducing-gas, oxidizing-gas mixture is carried out to produce superheated steam and hot gases for injection into the formation to convert and upgrade the heavy crude or bitumen into lighter hydrocarbons. The temperature of the superheated steam is sufficiently high to cause pyrolysis and/or hydrovisbreaking when hydrogen is present, which increases the API gravity and lowers the viscosity of the hydrocarbon in situ. The '867 patent states that an alternative reducing gas may be comprised principally of hydrogen with lesser amounts of carbon monoxide, carbon dioxide, and hydrocarbon gases.

The '867 patent also discloses fracturing the formation prior to injection of the steam. The '867 patent discloses both a cyclic process, wherein the injection and production occur in the same well, and a continuous drive process involving pumping steam through downhole burners in wells surrounding the producing wells. In the continuous drive process, the '867 patent teaches to extend the fractured zones to adjacent wells. Although this and other designs are workable, an improved burner design for downhole steam generators would be desirable.

SUMMARY OF THE INVENTION

Embodiments of a system, method, and apparatus for a downhole burner for a steam generator are disclosed. The downhole burner includes an injector and a cooling liner. Fuel, steam and oxidizer lines are connected to the injector. The burner is enclosed within a burner casing. The burner casing and burner form a steam channel that surround the injector and cooling liner. The steam enters the burner through holes in the cooling liner. Combustion occurring within the cooling liner heats the steam and increases its quality. The heated, high-quality steam and combustion products exit the burner and enter an oil-bearing formation to upgrade and improve the mobility of heavy crude oils held in the formation.

The injector includes a face plate having injection holes for the injection of fuel and oxidizer into the burner. The face plate also has an igniter for igniting fuel and oxidizer injected into the burner. Fuel and oxidizer holes are arranged in concentric rings in the face plate to produce a shower head stream pattern of fuel and oxidizer. The injector also comprises a cover plate having an oxidizer inlet, an oxidizer distribution manifold plate having oxidizer holes, and a fuel distribution manifold plate having fuel and oxidizer holes.

The injector is positioned at an upper end of the cooling liner. The inner diameter of the cooling liner is slightly larger than the diameter of the injector to allow small amounts of steam to leak past for additional cooling. The cooling liner includes an effusion cooling section and an effusion cooling and jet mixing section. The heated steam and combustion products exit the cooling liner through an outlet at its lower end. The effusion cooling section includes effusion holes for injecting small jets of steam along the surface of the cooling liner to provide a layer of cooler gases to protect the liner. The effusion cooling and jet mixing section has both effusion holes and mixing holes. The effusion holes cool the liner by directing steam along the wall while the mixing holes inject steam further toward central portions of the burner.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Although the following detailed description contains many specific details for purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations thereon, the present invention.

Figure 1:
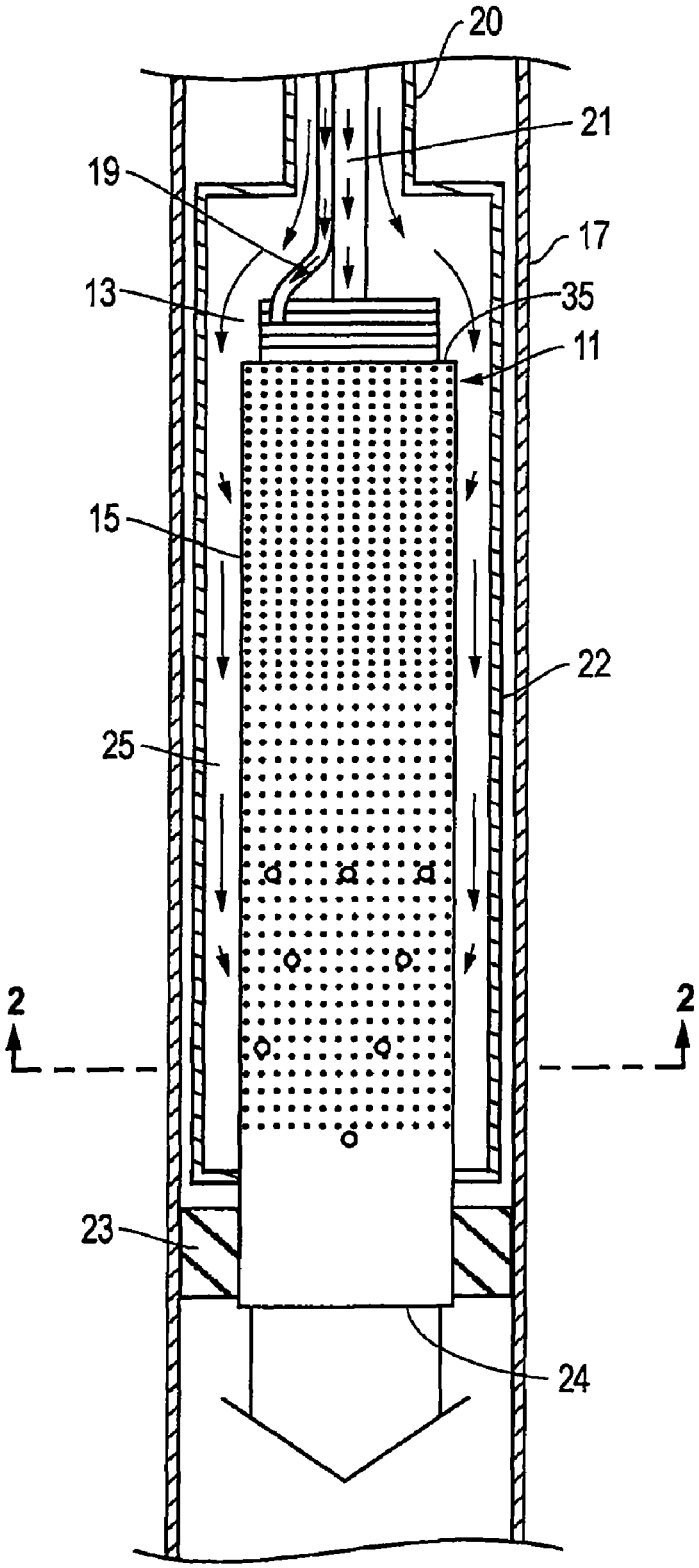
FIG. 1 is a side view of one embodiment of a downhole burner positioned in a well having a casing and packer shown in sectional view taken along the longitudinal axis of the casing.

FIG. 1 depicts a downhole burner 11 positioned in a well according to an embodiment of the present invention. The well may comprise various wellbore configurations including, for example, vertical, horizontal, SAGD, or various combinations thereof. One skilled in the art will recognize that the burner also functions as a heater for heating the fluids entering the formation. A casing 17 and a packer 23 are shown in cross-section taken along the longitudinal axis of casing 17. Downhole burner 11 includes an injector 13 and a cooling liner 15 comprising a hollow cylindrical sleeve. A fuel line 19 and an oxidizer line 21 are connected to and in fluid communication with injector 13.

A separate $CO_2$ line also may be utilized. The $CO_2$ may be injected at various and/or multiple locations along the liner, including at the head end, through the liner 15 or injector 13, or at the exit prior to the packer 23, depending on the application. In the one embodiment, burner 11 is enclosed within an outer shell or burner casing 22.

The burner 11 may be suspended by fuel line 19, oxidizer line 21 and steam line 20 while being lowered down the well. In another embodiment, a shroud or string of tubing (neither shown) may suspend burner 11 by attaching to injector 13 and/or cooling liner 15. When installed, burner 11 could be supported on packer 23 or casing 17. In one embodiment, burner casing 22 and burner 11 form an annular steam channel 25, which substantially surrounds the exterior surfaces of injector 13 and cooling liner 15.

In operation, steam having a preferable steam quality of approximately 50% to 90% (e.g., 80% to 100%), or some degree of superheated steam, may be formed at the surface of a well and fluidly communicated to steam channel 25 at a pressure of, for example, about 1600 psi. The steam arriving in steam channel 25 may have a steam quality of approximately 70% to 90% due to heat loss during transportation down the well. In one embodiment, burner 11 has a power output of approximately 13 MMBtu/hr and is designed to produce about 3200 bpd (barrels per day) of superheated steam (cold water equivalent) with an outlet temperature of around 700° F. at full load. Steam at lower temperatures may also be feasible.

Steam communicated to burner 11 through steam channel 25 may enter burner 11 through a plurality of holes in cooling liner 15. Combustion occurring within cooling liner 15 heats the steam and increases its steam quality. The heated, high-quality steam and combustion products exit burner 11 through outlet 24. The steam and combustion products (i.e., the combusted fuel and oxidizer (e.g., products) or exhaust gases) then may enter an oil-bearing formation in order to, for example, upgrade and improve the mobility of heavy crude oils held in the formation. Those skilled in the art will recognize that burners having the design of burner 11 may be built to have almost any power output, and to provide almost any steam output and steam quality.

Figure 2:
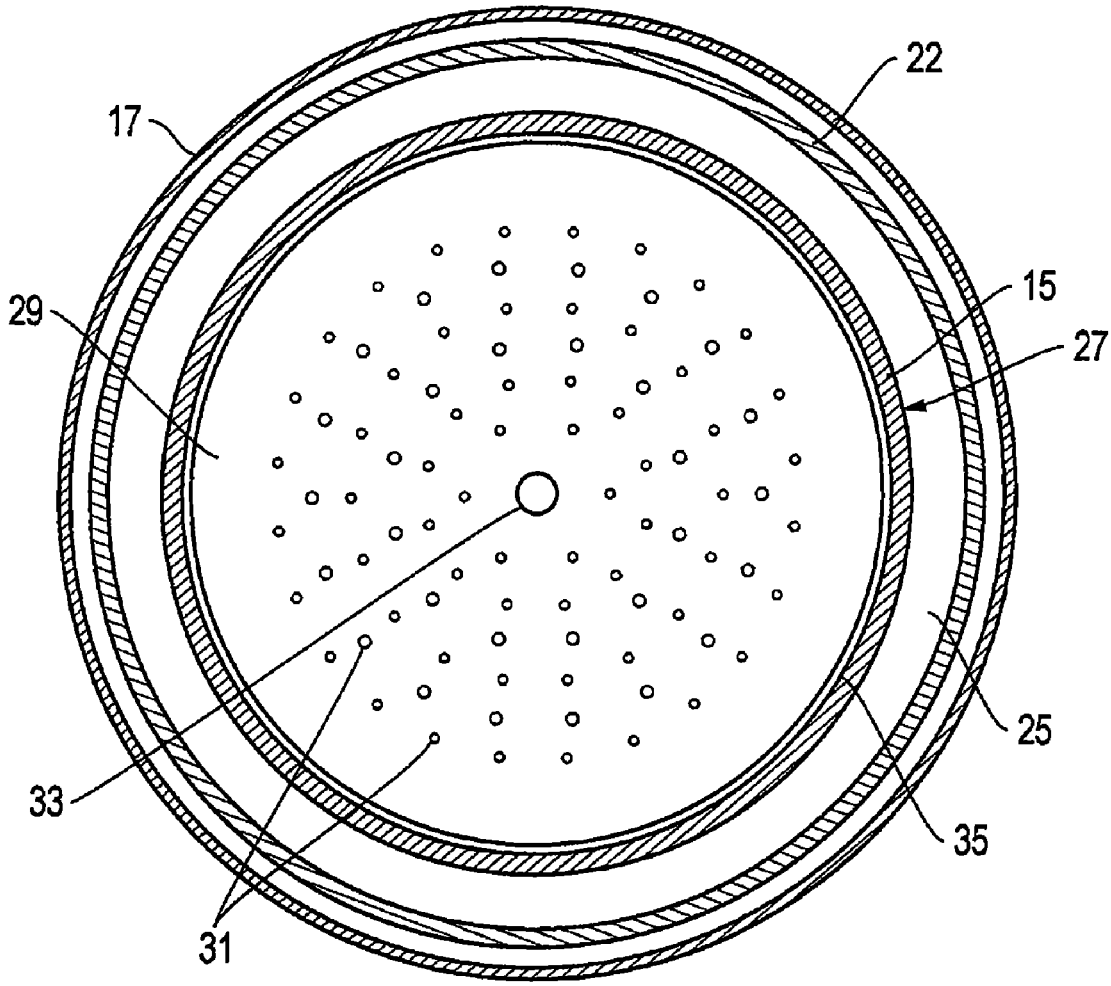
FIG. 2 is a bottom sectional view of the assembly of FIG. 1 taken along line 2-2 of FIG. 1 and is constructed in accordance with the invention.

FIG. 2 depicts an upward view of the downhole burner of FIG. 1. Steam channel 25 is formed between burner casing 22 and cooling liner wall 27 of cooling liner 15. Injector face plate 29 of injector 13 (see FIG. 1) has formed therein a plurality of injection holes 31 for the injection of fuel and oxidizer into the burner. Injector face plate 29 further includes an igniter 33 for igniting fuel and oxidizer injected into the burner. Igniter 33 could be a variety of devices and it could be a catalytic device. A small gap 35 may be provided between injector face plate 29 and cooling liner wall 27 so that steam can leak past and cool injector face plate 29.

The invention is suitable for many different types and sizes of wells. For example, in one embodiment designed for use in a well having a well casing diameter of 7⅝-inches, burner casing 22 has an outer diameter of 6 inches and a wall thickness of 0.125 inches; cooling liner wall 27 has an outer diameter of 5 inches, an inner diameter of 4.75 inches, and a wall thickness of 0.125 inches; injector face plate 29 has a diameter of 4.65 inches; steam channel 25 has an annular width between cooling liner wall 27 and burner casing 22 of 0.375 inches; and gap 35 has a width of 0.050 inches.

Figure 11:
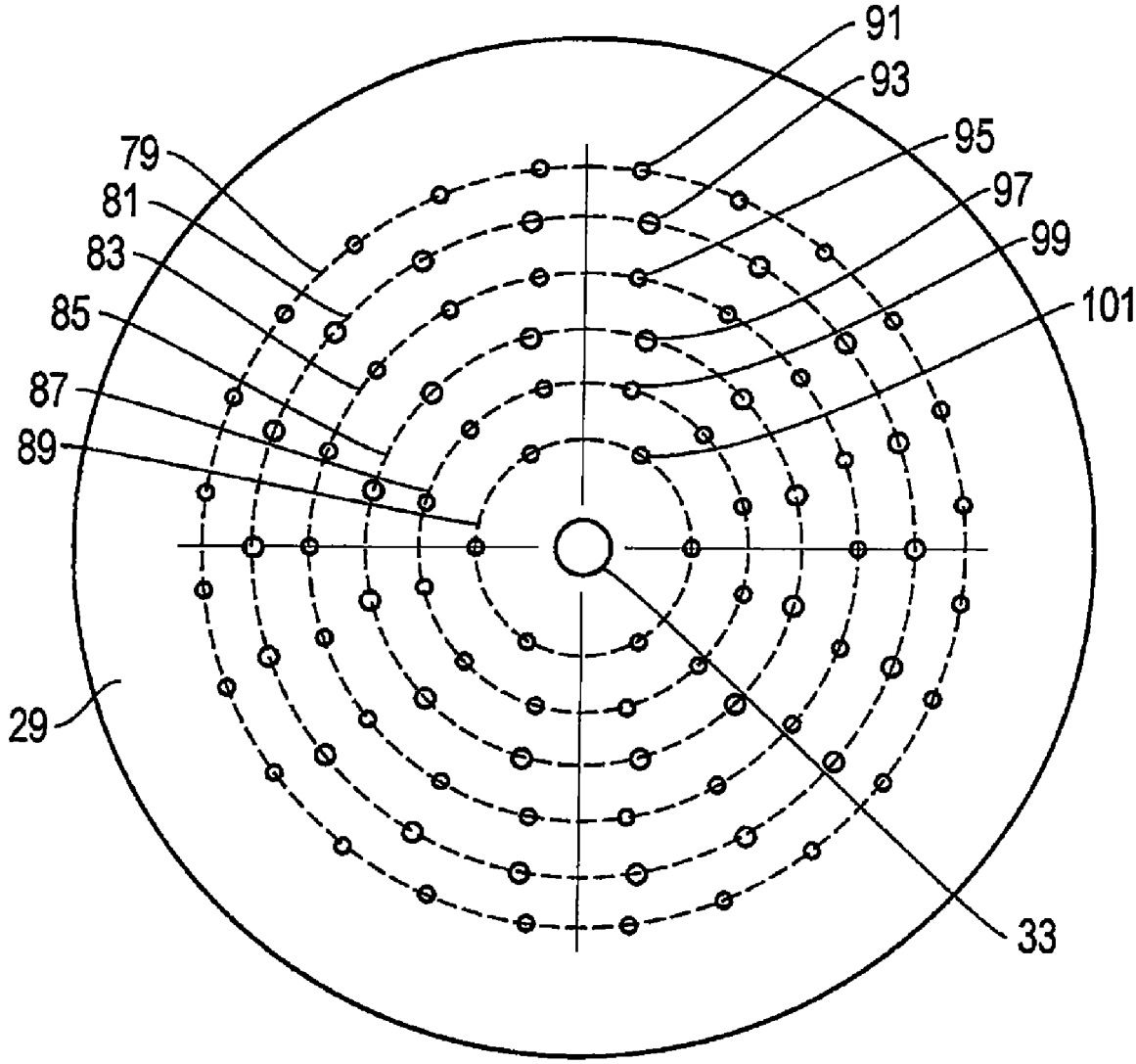
FIG. 11 is a bottom view of one embodiment of an injector face plate constructed in accordance with the invention.

FIG. 11 illustrates one embodiment of the injector face plate 29. Injector face plate 29 forms part of injector 13 and includes igniter 33. Fuel holes 93, 97 may be arranged in concentric rings 81, 85. Oxidizer holes 91, 95, 99, 101 also may be arranged in concentric rings 79, 83, 87, 89. Fuel holes 93, 97 and oxidizer holes 91, 95, 99, 101 correspond to injection holes 31 of FIG. 2. In one embodiment, concentric ring 79 has a radius of 1.75 inches, concentric ring 81 has a radius of 1.50 inches, concentric ring 83 has a radius of 1.25 inches, concentric ring 85 has a radius of 1.00 inches, concentric ring 87 has a radius of 0.75 inches, and concentric ring 89 has a radius of 0.50 inches. In one embodiment, oxidizer holes 91 have a diameter of 0.056 inches, oxidizer holes 95 have a diameter of 0.055 inches, oxidizer holes 99 have a diameter of 0.052 inches, oxidizer holes 101 have a diameter of 0.060 inches, and fuel holes 93, 97 have a diameter of 0.075 inches.

In one embodiment, fuel holes 93, 97 and oxidizer holes 91, 95, 99, 101 produce a shower head stream pattern of fuel and oxidizer rather than an impinging stream pattern or a fogging effect. Although other designs may be used and are within the scope of the present invention, a shower head design moves the streams of fuel and oxidizer farther away from injector face plate 29. This provides a longer stand-off distance between the high flame temperature of the combusting fuel and injector face plate 29, which in turn helps to keep injector face plate 29 cooler.

Figure 3:
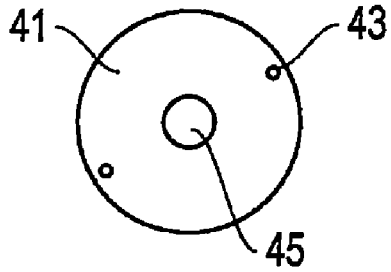
FIG. 3 is a plan view of one embodiment of a cover plate constructed in accordance with the invention.
Figure 4:
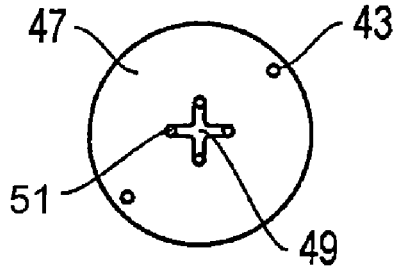
FIG. 4 is a plan view of one embodiment of an oxidizer distribution manifold plate constructed in accordance with the invention.

FIG. 3 shows a cover plate 41 in accordance with an embodiment of the invention. Cover plate 41 forms part of injector 13 and may include oxidizer inlet 45 and alignment holes 43. FIG. 4 shows an oxidizer distribution manifold plate 47 according to an embodiment of the invention. Oxidizer distribution manifold plate 47 forms part of injector 13 and may include oxidizer manifold 49, oxidizer holes 51, and alignment holes 43.

Figure 5:
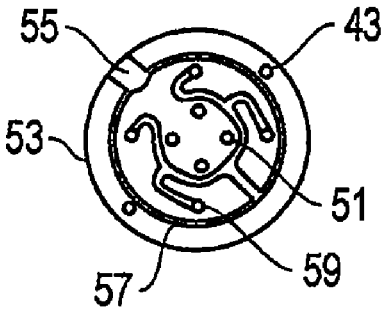
FIG. 5 is a plan view of one embodiment of a fuel distribution manifold plate constructed in accordance with the invention.

FIG. 5 shows a fuel distribution manifold plate 53 according to an embodiment of the invention. Fuel distribution manifold plate 53 forms part of injector 13 may include oxidizer holes 51 and alignment holes 43. Fuel distribution manifold plate 53 also may include fuel inlet 55, fuel manifold or passages 57, and fuel holes 59. Fuel manifold 57 may be formed to route fuel throughout the interior of fuel distribution manifold plate 53 as a means of cooling the plate.

Figure 6:
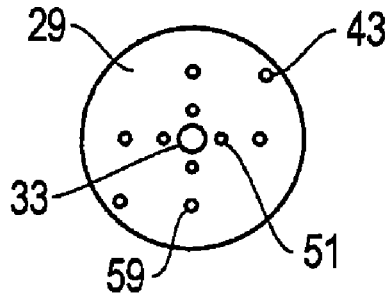
FIG. 6 is a plan view of one embodiment of an injector face plate constructed in accordance with the invention.

FIG. 6 shows an injector face plate 29 according to an embodiment of the invention. Injector face plate 29 forms part of injector 13 and may include oxidizer holes 51, fuel holes 59, and alignment holes 43. Oxidizer holes 51 of FIG. 6 correspond to oxidizer holes 91, 95, 99, 101 of FIG. 11 and fuel holes 59 of FIG. 6 correspond to fuel holes 93, 97 of FIG. 11.

Figure 7:
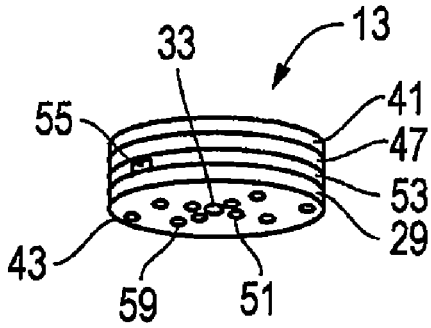
FIG. 7 is a lower isometric view of one embodiment of an injector constructed in accordance with the invention.

FIG. 7 depicts the assembled components of the injector 13 according to one embodiment of the invention. Injector 13 may be formed by the plates of FIGS. 3-6, with the alignment holes 43 located in each plate arranged in alignment. More specifically, injector 13 may be formed by stacking cover plate 41 on top of oxidizer distribution manifold plate 47, which is stacked on top of fuel distribution manifold plate 53, which is stacked on top of injector face plate 29. As shown in the drawing, alignment holes 43, oxidizer holes 51, and fuel holes 59 are visible on the exterior, or bottom, side of injector face plate 29. Fuel inlet 55 of fuel distribution manifold plate 53 also is visible on the side of injector 13. A pin may be inserted through alignment holes 43 to secure plates 29, 41, 47, 53 in alignment. Injector 13 and the plates forming injector 13 have been simplified in FIGS. 3-7 to better illustrate the relationship of the plates and the design of the injector. Commercial embodiments of injector 13 may include a greater number of oxidizer and fuel holes, and may include plates that are relatively thinner than those shown in FIGS. 3-7.

Figure 8:
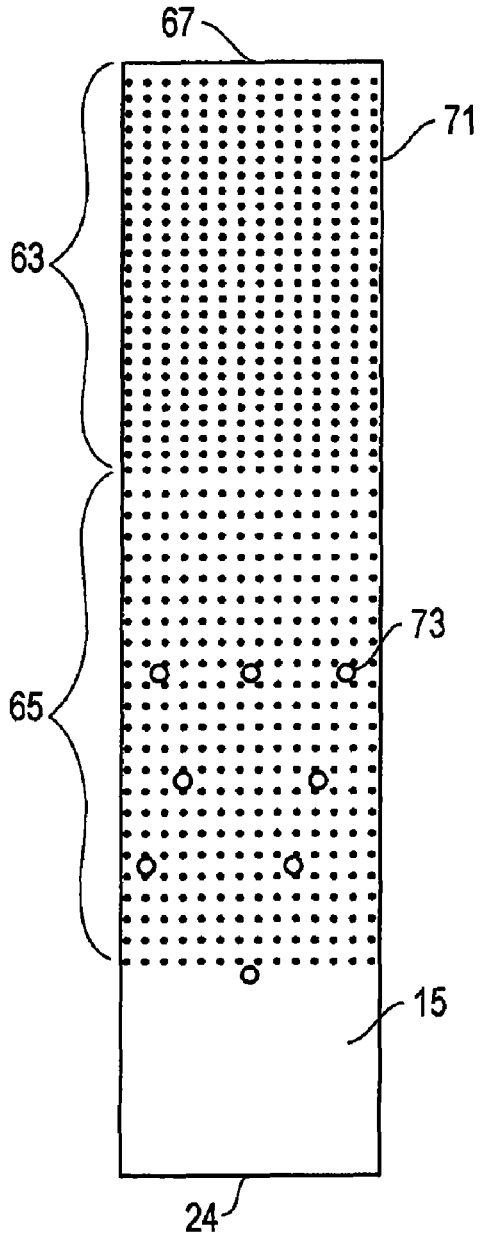
FIG. 8 is a side view of one embodiment of a cooling liner constructed in accordance with the invention.

FIG. 8 illustrates one embodiment of the cooling liner 15. The cooling liner 15 forms part of burner 11 as shown in FIG. 1. Injector 13 may be positioned at the inlet, or upper end, 67 of cooling liner 15. Cooling liner 15 includes two major sections: effusion cooling section 63, and effusion cooling and jet mixing section 65. In a one embodiment, section 63 extends for approximately 7.5 inches from the bottom of injector 13 and section 65 extends for approximately 10 inches from the bottom of section 63. Those skilled in the art will recognize that other lengths for sections 63, 65 are within the scope of the invention. Heated steam and combustion products exit cooling liner 15 through outlet 24.

Figure 9:
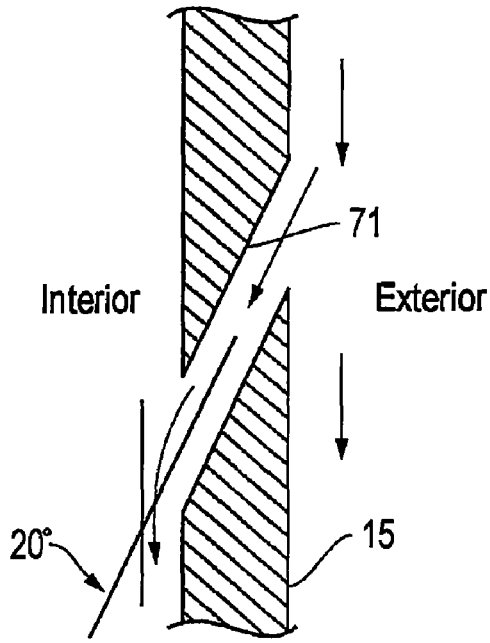
FIG. 9 is an enlarged sectional side view of a portion of the cooling liner of FIG. 8 illustrating an effusion holes therein.

Effusion cooling section 63 may be characterized by the inclusion of a plurality of effusion holes 71. Effusion cooling section 63 acts to inject small jets of steam along the surface of cooling liner 15, thus providing a layer of cooler gases to protect liner 15. In one embodiment, effusion holes 71 may be angled 20 degrees off of an internal surface of cooling liner 15 and aimed downstream of inlet 67, as shown in FIG. 9. Angling of effusion holes 71 helps to prevent steam from penetrating too far into burner 11 and allows the steam to move along the walls of liner 15 to keep it cool. The position of effusion cooling section 63 may correspond to the location of the flame position in burner 11. In one embodiment, approximately 37.5% of the steam provided to burner 11 through steam channel 25 (FIG. 1) is injected by effusion cooling section 63.

Figure 10:
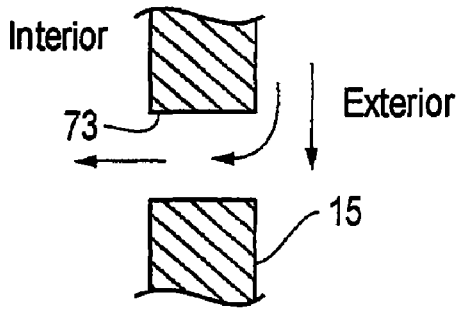
FIG. 10 is an enlarged sectional side view of a portion of the cooling liner of FIG. 8 illustrating a mixing hole therein.

Effusion cooling and jet mixing section 65 may be characterized by the inclusion of a plurality of effusion holes 71 as well as a plurality of mixing holes 73. Mixing holes 73 are larger than effusion holes 71, as shown in FIG. 10. Furthermore, mixing holes 73 may be set at a 90 degree angle off of an internal surface of cooling liner 15. Effusion holes 71 act to cool liner 15 by directing steam along the wall of liner 15, while mixing holes 73 act to inject steam further toward the central axial portions of burner 11.

In another embodiment, the invention further comprises injecting liquid water into the downhole burner and cooling the injector and/or liner with the water. The water may be introduced to the well and injected in numerous ways such as those described herein.

Table 1 summarizes the qualities and placement of the holes of sections 63, 65 in one embodiment. The first column defines the section of cooling liner 15 and the second column describes the type of hole. The third and fourth columns describe the starting and ending position of the occurrence of the holes in relation to the top of section 63, which may correspond to the bottom surface of injector 13 (see FIG. 1). The fifth column shows the percentage of total steam that is injected through each group of holes. The sixth column includes the number of holes while the seventh column describes the angle of injection. The eighth column shows the maximum percentage of jet penetration of the steam relative to the internal radius of cooling liner 15. The ninth column shows the diameter of the holes in each group.

TABLE 1

Example of Cooling Liner Properties

| Section | Hole Type | Start (inches) | End (inches) | % of Total Steam | Number of Holes | Injection Angle (degrees) | Radial Injection % | Hole Diameter (inches) |
|---|---|---|---|---|---|---|---|---|
| Effusion | Effusion | 0.00 | 3.00 | 15 | 720 | 20.0 | 3.90 | 0.0305 |
| Cooling | Effusion | 3.00 | 5.00 | 12.5 | 600 | 20.0 | 8.16 | 0.0305 |
| | Effusion | 5.00 | 7.50 | 10 | 480 | 20.0 | 6.81 | 0.0305 |
| Effusion | Mixing | 7.50 | 7.50 | 6.5 | 18 | 90.0 | 74.35 | 0.1268 |
| Cooling | Effusion | 7.50 | 9.50 | 4.8 | 180 | 20.0 | 6.39 | 0.0345 |
| and Jet | Mixing | 9.50 | 9.50 | 6.5 | 12 | 90.0 | 75.94 | 0.1553 |
| Mixing | Effusion | 9.50 | 11.50 | 4.8 | 180 | 20.0 | 5.39 | 0.0345 |
| | Mixing | 11.50 | 11.50 | 6.5 | 8 | 90.0 | 79.68 | 0.1902 |
| | Effusion | 11.50 | 13.50 | 4.8 | 180 | 20.0 | 4.66 | 0.0345 |

TABLE 1-continued

Example of Cooling Liner Properties

| Section | Hole Type | Start (inches) | End (inches) | % of Total Steam | Number of Holes | Injection Angle (degrees) | Radial Injection % | Hole Diameter (inches) |
|---|---|---|---|---|---|---|---|---|
| | Mixing | 13.50 | 13.50 | 6.5 | 6 | 90.0 | 80.43 | 0.2196 |
| | Effusion | 13.50 | 15.50 | 4.8 | 180 | 20.0 | 4.10 | 0.0345 |
| | Mixing | 15.50 | 15.50 | 6.5 | 5 | 90.0 | 78.24 | 0.2406 |
| | Effusion | 15.50 | 17.50 | 4.8 | 180 | 20.0 | 3.66 | 0.0345 |
| | Mixing | 17.50 | 17.50 | 6 | 4 | 90.0 | 75.93 | 0.2584 |

Embodiments of the downhole burner may be operated using various fuels. In one embodiment, the burner may be fueled by hydrogen, methane, natural gas, or syngas. One type of syngas composition comprises 44.65 mole % CO, 47.56 mole % $H_2$, 6.80 mole % $CO_2$, 0.37 mole % $CH_4$, 0.12 mole % Ar, 0.29 mole % $N_2$, and 0.21 mole % $H_2S$+COS. One embodiment of the oxidizer for all the fuels includes oxygen and could be, for example, air, rich air, or pure oxygen. Although other temperatures may be employed, an inlet temperature for the fuel is about 240° F. and an inlet temperature for the oxidant is about 186.5° F.

Table 2 summarizes the operating parameters of one embodiment of a downhole burner that is similar to that described in FIGS. 1-11. The listed parameters are considered separately for a downhole burner operating on hydrogen, syngas, natural gas, and methane fuels. Other fuels, such as liquid fuels, could be used.

TABLE 2

Downhole burner producing about 3200 bpd of steam

| Parameter | Units | $H_2$—$O_2$ | Syngas-$O_2$ | $CH_4$—$O_2$ |
|---|---|---|---|---|
| Power Required | MMBtu/hr | 13.0 | 13.0 | 13.0 |
| | | Fuel | | |
| Mass Flow | lb/hr | 376 | 3224 | 985 |
| Inlet Pressure | psi | 1610 | 1680 | 1608 |
| Hole Diameter | inches | 0.075 | 0.075 | 0.075 |
| Number of Holes | | 30 | 30 | 30 |
| | | Oxidizer | | |
| Mass Flow | lb/hr | 3011 | 2905 | 3939 |
| Inlet Pressure | psi | 1629 | 1626 | 1648 |
| Average Hole Diameter | inches | 0.055 | 0.055 | 0.055 |
| Number of Holes | | 60 | 60 | 60 |

Embodiments of the downhole burner also may be operated using $CO_2$ as a coolant in addition to steam. $CO_2$ may be injected through the injector or through the cooling liner. The power required to heat the steam increases when diluents such as $CO_2$ are added. In the example of Table 3, a quantity of $CO_2$ sufficient to result in 20 volumetric percent of $CO_2$ in the exhaust stream of the burner is added downstream of the injector. It can be seen that the increase in inlet pressures is minimal although the required power has increased.

TABLE 3

Downhole burner producing 3200 bpd of steam and 20 volumetric percent $CO_2$. $CO_2$ is added downstream of injector.

| Parameter | Units | $H_2$—$O_2$ | Syngas-$O_2$ | $CH_4$—$O_2$ |
|---|---|---|---|---|
| Power Required | MMBtu/hr | 14.7 | 14.1 | 14.3 |
| | | Fuel | | |
| Mass Flow | lb/hr | 427 | 3496 | 1084 |
| Inlet Pressure | psi | 1614 | 1699 | 1610 |
| Hole Diameter | inches | 0.075 | 0.075 | 0.075 |
| Number of Holes | | 30 | 30 | 30 |
| | | Oxidizer | | |
| Mass Flow | lb/hr | 3413 | 3149 | 4335 |
| Inlet Pressure | psi | 1637 | 1630 | 1658 |
| Average Hole Diameter | inches | 0.055 | 0.055 | 0.055 |
| Number of Holes | | 60 | 60 | 60 |

In the example of Table 4, a quantity of $CO_2$ sufficient to result in 20 volumetric percent of $CO_2$ in the exhaust stream of the burner has been added through the fuel line and fuel holes of the burner. It can be seen that the fuel inlet pressure is much higher than in the example of Table 3. $CO_2$ also could be delivered through the oxidizer line and oxidizer holes, or a combination of delivery methods could be used. For example, the $CO_2$ could be delivered into burner 11 with the fuel.

In other embodiments, the diameters of the fuel and oxidizer injectors 31 may differ to optimize the injector plate for a particular set of conditions. In the present embodiment, the diameters are adequate for the given conditions, assuming that supply pressure on the surface is increased when necessary.

TABLE 4

Downhole burner producing 3200 bpd of steam and 20 volumetric percent $CO_2$. $CO_2$ is added through the fuel line and fuel holes.

| Parameter | Units | $H_2$—$O_2$ | Syngas-$O_2$ | $CH_4$—$O_2$ |
|---|---|---|---|---|
| Diluent/Fuel Mass Ratio | | 29.68 | 2.14 | 8.67 |
| Percent Diluent in Fuel Line | | 100 | 100 | 100 |
| Percent Diluent in Oxidizer Line | | 0 | 0 | 0 |
| Power Required | MMBtu/hr | 14.7 | 14.1 | 14.3 |

TABLE 4-continued

Downhole burner producing 3200 bpd of steam and 20 volumetric percent $CO_2$. $CO_2$ is added through the fuel line and fuel holes.

| Parameter | Units | $H_2$—$O_2$ | Syngas-$O_2$ | $CH_4$—$O_2$ |
|---|---|---|---|---|
| | | Fuel | | |
| Mass Flow | lb/hr | 427 | 3496 | 1084 |
| Inlet Pressure | psi | 2416 | 2216 | 1988 |
| Hole Diameter | inches | 0.075 | 0.075 | 0.075 |
| Number of Holes | | 30 | 30 | 30 |
| | | Oxidizer | | |
| Mass Flow | lb/hr | 3413 | 3149 | 4335 |
| Inlet Pressure | psi | 1637 | 1630 | 1658 |
| Average Hole Diameter | inches | 0.055 | 0.055 | 0.055 |
| Number of Holes | | 60 | 60 | 60 |

Burner 11 can be useful in numerous operations in several environments. For example, burner 11 can be used for the recovery of heavy oil, tar sands, shale oil, bitumen, and methane hydrates. Such operations with burner 11 are envisioned in situ under tundra, in land-based wells, and under sea.

The invention has numerous advantages. The dual purpose cooling/mixing liner maintains low wall temperatures and stresses, and mixes coolants with the combustion effluent. The head end section of the liner is used for transpiration cooling of the line through the use of effusion holes angled downstream of the injector plate. This allows for coolant (primarily partially saturated steam at about 70% to 80% steam quality) to be injected along the walls, which maintains low temperatures and stress levels along liner walls, and maintains flow along the walls and out of the combustion zone to prevent flame extinguishment.

The back end section of the liner provides jet mixing of steam (and other coolants) for the combustion effluent. The pressure difference across the liner provides sufficient jet penetration through larger mixing holes to mix coolants into the main burner flow, and superheat the coolant steam. The staggered hole pattern with varying sizes and multiple axial distances promotes good mixing of the coolant and combustion effluent prior to exhaust into the formation. A secondary use of transpiration cooling of the liner is accomplished through use of effusion holes angled downstream of the combustion zone to maintain low temperatures and stress level along liner walls in jet mixing section of the burner similar to transpiration cooling used in the head end section.

The invention further provides coolant flexibility such that the liner can be used in current or modified embodiment with various vapor/gaseous phase coolants, including but not limited to oil production enhancing coolants, in addition to the primary coolant, steam. The liner maintains effectiveness as both a cooling and mixing component when additional coolants are used.

The showerhead injector uses alternating rings of axial fuel and oxidizer jets to provide a uniform stable diffusion flame zone at multiple pressures and turndown flow rates. It is designed to keep the flame zone away from injector face to prevent overheating of the injector plate. The injector has flexibility to be used with multiple fuels and oxidizers, such as hydrogen, natural gases of various compositions, and syngases of various compositions, as well as mixtures of these primary fuels. The oxidizers include oxygen (e.g., 90-95% purity) as well as air and "oxygen-rich" air for appropriate applications. The oil production enhancing coolants (e.g., carbon dioxide) can be mixed with the fuel and injected through the injector plate.

In other embodiments, the invention is used to disperse nanocatalysts into heavy oil and/or bitumen-bearing formations under conditions of time, temperature, and pressure that cause refining reactions to occur, such as those described herein. The nanocatalysts are injected into the burner via any of the conduits or means described herein (including an optional separate line), and a nanocatalyst-reducing gas mixture is passed through the burner where it is heated, or, the mixture is injected alongside the downhole steam generator. In either case, the mixture is then injected into the formation where it promotes converting and upgrading the hydrocarbon downhole, in situ, including sulfur reduction. The reducing gas may comprise hydrogen, syngas, or hydrogen donors such as tetralin or decalin. The appropriate catalyst causes the reactions to take place at a temperature that is lower than the temperature of thermal (i.e., non-catalytic) reactions. Advantageously, less coke is formed at the lower temperature.

Alternatively, the carrier gas is preheated on the surface prior to entering the transfer vessel. The carrier gas may be preheated using any heat source and heat exchange device. The preheated gas is supplied to the transfer vessel at an elevated temperature that provides for heat losses in the heat transfer vessel as well as the well bore and still be sufficient to maintain the in situ catalytic reactions for which the catalyst was designed.

The nanocatalyst-reducing gas mixture is injected into the formation where it promotes converting and upgrading the hydrocarbon. When the in situ catalytic reaction comprises hydrovisbreaking, hydrocracking, hydrodesulfurization, or other hydrotreating reactions, hydrogen is the preferred carrier gas. For other types of reactions, the carrier gas is one or more of the reactants. For example, if the reaction that is promoted is in situ combustion, the carrier gas is oxygen, rich air, or air. In another embodiment, carbon dioxide is the carrier gas for a cracking catalyst that promotes in situ cracking of the hydrocarbon in the formation.

Figure 12:
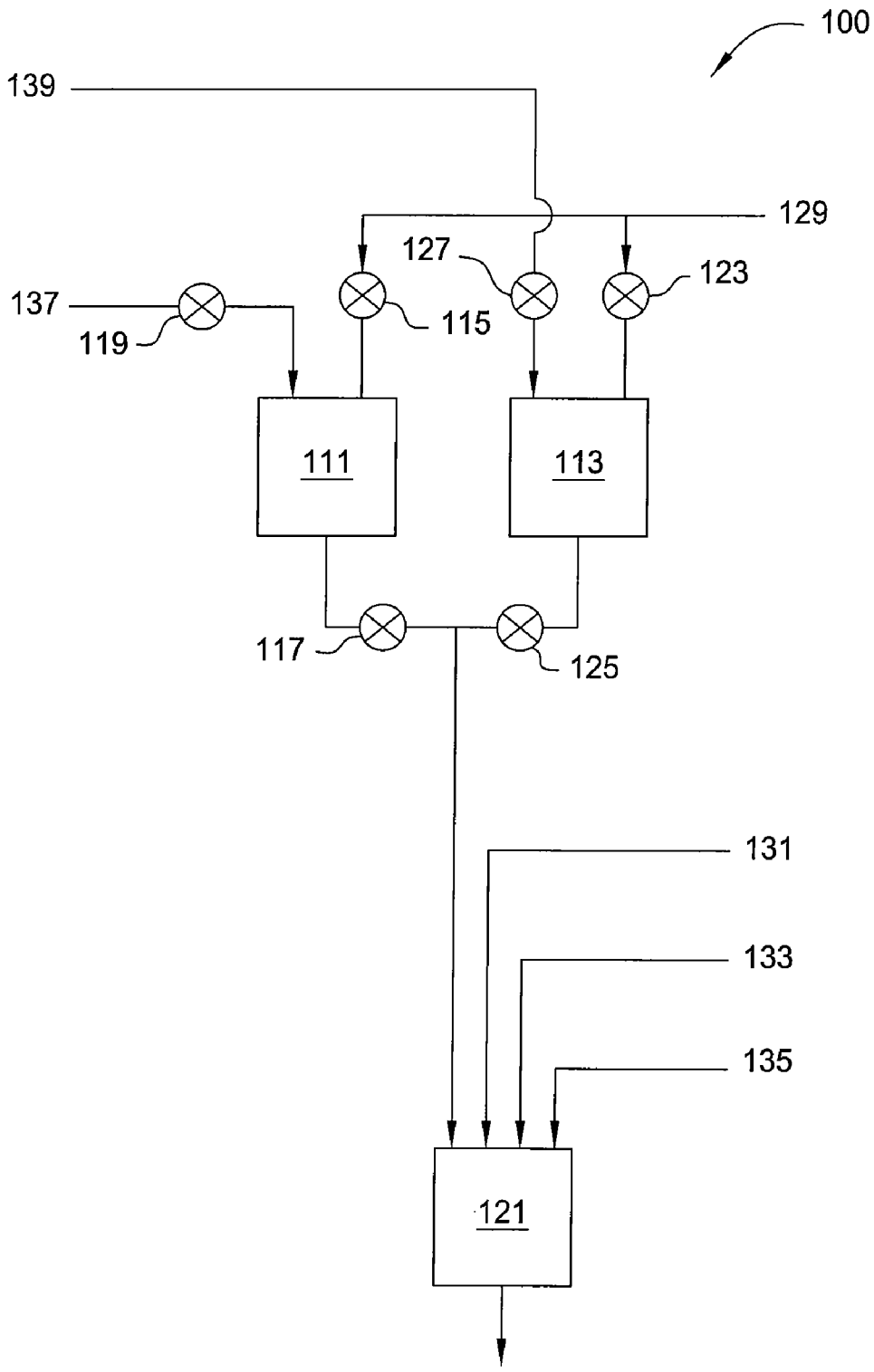
FIG. 12 is a schematic diagram of one embodiment of a system for introducing and distributing nanocatalysts in oil-bearing formations.

Referring now to FIG. 12, one embodiment of the invention uses two vessels 111, 113 to prepare and transport nanocatalysts. Vessel 111 is in catalyst preparation mode and vessel 113 is in transfer mode. When a catalyst preparation and transfer cycle is complete, the roles of the two vessels 111, 113 are reversed. When vessel 111 is in catalyst preparation mode, valves 115 and 117 are closed. The catalyst materials 137 are added to vessel 111 through a separate port(s) 119, mixed and dried. When the catalyst preparation is complete, valves 115 and 117 are opened and the carrier gas 129 flows through vessel 111, carrying the nanocatalysts particles into a feedline to a downhole steam generator 121. While vessel 111 is in catalyst preparation mode, vessel 113 is in transfer mode. In this configuration, valves 123 and 125 are open, valve 127 is closed, and the carrier gas 129 sweeps through vessel 113. Valve 127 controls the transfer of catalyst preparation materials 139 into vessel 113.

When the cycle of catalyst preparation in one vessel and the catalyst transfer from the other vessel is complete, the roles of the two vessels are reversed. The vessel where the catalyst was prepared becomes the transfer vessel, and the vessel that had the catalyst transferred out becomes the catalyst preparation vessel. This alternation of roles continues until the catalyst injection into the formation is no longer required.

One embodiment of the invention employs nanocatalysts prepared in a conventional manner. See, e.g., *Enhancing Activity of Iron-based Catalyst Supported on Carbon Nanoparticles by Adding Nickel and Molybdenum*, Ungula Priyanto, Kinya Sakanishi, Osamu Okuma, and Isao Mochida, *Preprints of Symposia: 220th ACS National Meeting*, Aug. 20-24, 2000, Washington, D.C. The catalyst is transported into a petroleum-bearing formation by a carrier gas. The gas is a reducing gas such as hydrogen and the catalyst is designed to promote an in situ reaction between the reducing gas and the oil in the reservoir.

In order for the conversion and upgrading reactions to occur in the reservoir, the catalyst, reducing gas, and the heavy oil or bitumen must be in intimate contact at a temperature of at least 400° F., and at a hydrogen partial pressure of at least 100 psi. The intimate contact, the desired temperature, and the desired pressure are brought about by means of a downhole steam generator. See, e.g., U.S. Pat. No. 4,465,130. The steam, nanocatalysts, and unburned reducing gases are forced into the formation by the pressure created by the downhole steam generator. Because the reducing gas is the carrier for the nanocatalysts, these two components will tend to travel together in the petroleum-bearing formation. Under the requisite heat and pressure, the reducing gas catalytically reacts with the heavy oil and bitumen thereby reducing its viscosity and % sulfur as well as increasing its API gravity.

Some catalysts comprise a metal adsorbed on a carbon nanotube. For those catalysts, the temperature of the upgrading reactions must be below the temperature that allows the steam to react with the carbon tubes. Other catalysts, such as $TiO_2$ or $TiO_2$-based, are not affected by steam and are effective in catalyzing upgrading reactions.

In the embodiment of FIG. 12, the two similar vessels 111, 113 operate in parallel and prepare the nanocatalyst and transfer it to the injection lines leading to the downhole steam generator 121. The vessels are separate from the continuous flow of reducing gas 131, oxidizing gas 133, and steam 135. For example, a nanocatalyst is prepared by impregnating Ni salt, and Mo salt on nanoparticles (e.g., Ketjen Black) resulting in a catalyst with 2% Ni, 10% Mo and 88% Ketjen Black. When the batch of catalyst is finished and dried, the carrier gas is passed through the catalyst-containing vessel thereby carrying the catalyst into the injection well and then into the formation. While the catalyst that was prepared in one vessel is being transferred to the lines leading to the injection well, another batch of catalyst is prepared in the other vessel. The alternation of catalyst preparation and transfer is continued in each of the two vessels as long as the in situ process benefits from use of the catalyst.

This embodiment has many advantages including that the downhole steam generator makes it possible to bring together hydrogen, a hydrogenation catalyst, heavy oil in place, heat, and pressure, thereby causing catalytic reactions to occur in the reservoir. Because catalysts with a wide variety of reactivities and selectivities can be synthesized, the invention permits many opportunities for in situ upgrading. The nature of catalysts is to promote reactions at milder conditions (e.g., lower temperatures and pressures) than thermal or non-catalytic reactions. This means that hydrogenation, for example, may be conducted in situ at shallower depths than conventional pyrolysis and other thermal reactions.

Another advantage of the process when used without a downhole steam generator is the ease of operation without the generator. The lack of downhole equipment results in less maintenance and less downtime for injection of the catalyst and reactants. One disadvantage is the heat losses in the catalyst preparation/transfer vessels and in the well bore. The invention provides a platform technology that is applicable to a wide range of in situ reactions in a wide range of heavy oil, ultraheavy oil, natural bitumen, and lighter deposits.

Furthermore, the invention has many applications, including in situ catalytic hydrogenation, in situ catalytic hydrovisbreaking, in situ catalytic hydrocracking, in situ catalytic combustion, in situ catalytic reforming, in situ catalytic alkylation, in situ catalytic isomerization, and other in situ catalytic refining reactions. Although all of these reactions are used in conventional petroleum refining, none of them are used for in situ catalytic reactions.

Although some embodiments of the present invention have been described in detail, it should be understood that various changes, substitutions, and alterations can be made hereupon without departing from the principle and scope of the invention.

What is claimed is:

1. A downhole burner for a well, comprising:

a burner casing;

a liner coupled to the burner casing for combusting a fuel and an oxidizer;

an injector coupled to the burner casing for injecting the fuel and the oxidizer into the liner;

a steam channel located inside the burner casing and surrounding exterior surfaces of the injector and the liner; and the liner having a plurality of holes for communicating steam from the steam channel to an interior of the liner downstream from the injector, wherein the liner comprises an effusion cooling section located adjacent to the injector and an effusion cooling and jet mixing section located adjacent to the effusion cooling section, wherein the effusion cooling section has a first plurality of effusion holes disposed through a wall of the liner at an angle relative to the longitudinal axis of the wall and operable to inject small jets of steam through the wall to provide a layer of cooler gases to protect the wall of the liner, wherein the effusion cooling and jet mixing section has a second plurality of effusion holes disposed through the wall of the liner at an angle relative to the longitudinal axis of the wall and operable to inject small jets of steam through the wall to provide a layer of cooler gases to protect the wall of the liner and a plurality of mixing holes disposed through the wall of the liner at an angle perpendicular to the longitudinal axis of the wall and operable to inject steam farther toward the longitudinal axis of the liner, wherein the mixing holes are larger than the effusion holes.

2. The downhole burner according to claim 1, wherein the effusion holes extend through the liner at a 20° angle relative to the longitudinal axis of the liner and are oriented to inject steam downstream of the injector, for moving the injected steam along the wall of the liner to lower a temperature thereof.

3. The downhole burner according to claim 1, wherein the mixing holes are oriented at a 90° angle relative to an internal surface of the liner to inject steam farther toward the longitudinal axis of the liner.

4. The downhole burner according to claim 1, wherein the injector comprises an injector face plate having a plurality of injection holes for injecting the fuel and oxidizer into the burner, the injector face plate also having an igniter for igniting the fuel and oxidizer injected into the burner.

5. The downhole burner according to claim 4, wherein a gap is formed between an outer diameter of the injector face plate and an inner diameter of the liner so that steam can leak past and cool the injector face plate.

6. The downhole burner according to claim 5, wherein the burner casing and the liner each have a wall thickness of about 0.125 inches, the steam channel has an annular width between the liner and the burner casing of about 0.375 inches, and the gap has a width of about 0.050 inches.

7. The downhole burner according to claim 4, wherein the injector face plate has fuel holes and oxidizer holes, each of which is arranged in concentric rings to produce a shower head stream pattern of fuel and oxidizer to move streams of the fuel and oxidizer away from the injector face plate, such that a stand-off distance is provided between a flame of the combusted fuel and oxidizer and the injector face plate.

8. The downhole burner according to claim 1, wherein the injector comprises (a) a cover plate having an oxidizer inlet, (b) an oxidizer distribution manifold plate having an oxidizer manifold and oxidizer holes coupled to the oxidizer inlet, and (c) a fuel distribution manifold plate having oxidizer holes, a fuel inlet, a fuel manifold for routing fuel through an interior of the fuel distribution manifold plate for cooling the fuel distribution plate, and fuel holes.

9. The downhole burner according to claim 1, wherein the injector comprises a cover plate on top of an oxidizer distribution manifold plate, the oxidizer distribution manifold plate is on top of a fuel distribution manifold plate, and the fuel distribution manifold plate is on top of an injector face plate.

10. A system for producing viscous hydrocarbons from a well having a casing, comprising:

a plurality of conduits for delivering fuel, an oxidizer and steam from a surface down through the casing; and a downhole burner secured to the plurality of conduits, the downhole burner comprising:

a burner casing;

an injector coupled to the plurality of conduits for injecting the fuel and oxidizer into the well;

a liner coupled to the burner casing located below the injector for combusting the fuel and oxidizer, the liner having an interior that defines a gap between the interior of the liner and an exterior of the injector for permitting steam to leak past and cool the injector;

a steam channel located inside the burner casing and surrounding exterior surfaces of the injector and the liner; and the liner having a plurality of holes for communicating steam from the steam channel to an interior of the liner downstream from the injector, wherein the liner comprises an effusion cooling section located adjacent to the injector, and an effusion cooling and jet mixing section located adjacent to the effusion cooling section and having a plurality of effusion holes and a plurality of mixing holes, the mixing holes being larger than the effusion holes, and the mixing holes being oriented at a 90 degree angle relative to an internal surface of the liner to inject steam farther toward a longitudinal axis of the liner.

11. The system according to claim 10, wherein the effusion cooling section has a plurality of effusion holes that inject small jets of steam through the liner to provide a layer of cooler gases to protect the liner, and the gap has a width of about 0.050 inches.

12. The system according to claim 11, wherein the effusion holes extend through the liner at a 20° angle relative to the longitudinal axis of the liner and are oriented to inject steam downstream of the injector, such that the injected steam moves along an interior wall of the liner to lower a temperature thereof.

13. The system according to claim 10, wherein approximately 37.5% of the steam provided through the steam channel is injected into the liner by the effusion cooling section.

14. The system according to claim 10, wherein the steam has a steam quality of approximately 80% to 100% formed at the surface of the well that is fluidly communicated to the steam channel at a pressure of about 1600 psi.

15. The system according to claim 14, wherein the steam arriving at the steam channel has a steam quality of about 50% to 90%.

16. The system according to claim 10, wherein the downhole burner has a power output of approximately 13 MMBtu/hr for producing about 3200 bpd of superheated steam with an outlet temperature of about 700° F. at full load.

17. The system according to claim 10, wherein the injector comprises an injector face plate having a plurality of injection holes for injecting the fuel and oxidizer into the burner, the injector face plate also having an igniter for igniting the fuel and oxidizer injected into the burner.

18. The system according to claim 17, wherein the injector face plate has fuel holes and oxidizer holes, each of which is arranged in concentric rings to produce a shower head stream pattern of fuel and oxidizer to move streams of the fuel and oxidizer away from the injector face plate, such that a stand-off distance is provided between a flame of the combusted fuel and oxidizer and the injector face plate.

19. The system according to claim 10, wherein a nanocatalyst is injected into the well to promote converting and upgrading the hydrocarbons downhole.

20. The system according to claim 10, wherein the injector comprises (a) a cover plate having an oxidizer inlet, (b) an oxidizer distribution manifold plate having an oxidizer manifold and oxidizer holes coupled to the oxidizer inlet, and (c) a fuel distribution manifold plate having oxidizer holes, a fuel inlet, a fuel manifold for routing fuel through an interior of the fuel distribution manifold plate for cooling the fuel distribution plate, and fuel holes.

21. The system according to claim 10, wherein the injector comprises a cover plate on top of an oxidizer distribution manifold plate, the oxidizer distribution manifold plate is on top of a fuel distribution manifold plate, and the fuel distribution manifold plate is on top of an injector face plate.

22. The system according to claim 10, further comprising a separate $CO_2$ conduit for injecting $CO_2$ into at least one location of the downhole burner, including the injector, a head end of the liner, through the liner, and at an exit of the liner prior to a packer in the casing.

23. A method of producing viscous hydrocarbons from a well having a casing, comprising:

(a) providing a downhole burner having a burner casing, an injector, and a liner, wherein the liner comprises:

an effusion cooling section located adjacent to the injector and having a plurality of effusion holes that inject small jets of steam through the liner to provide a layer of cooler gases to protect the liner; and an effusion cooling and jet mixing section located adjacent to the effusion cooling section and having a plurality of effusion holes and a plurality of mixing holes, the mixing holes being larger than the effusion holes and oriented at a 90 degree angle relative to an internal surface of the liner to inject steam farther toward a longitudinal axis of the liner;

(b) lowering the downhole burner into the well;

(c) delivering fuel, an oxidizer and steam from the surface down through the casing to the downhole burner;

(d) injecting the fuel and oxidizer into the downhole burner with the injector;

(e) combusting the fuel and oxidizer with the liner;

(f) delivering steam through a steam channel located between the burner casing and the injector and liner;

(g) injecting steam from the steam channel, through holes in the liner, to an interior of the liner to superheat the steam with the combusted fuel and oxidizer to increase the steam quality of the steam, and leaking steam past the injector and cooling the injector with a gap located between an interior of the liner and an exterior of the injector; and (h) releasing the combusted fuel and oxidizer and the superheated steam from the liner into an oil-bearing formation to upgrade and improve the mobility of heavy crude oils held in the oil-bearing formation.

24. The method according to claim 23, wherein the effusion holes extend through the liner at a 20° angle relative to the longitudinal axis of the liner and are oriented to inject steam downstream of the injector, such that the injected steam moves along an interior wall of the liner to lower a temperature thereof.

25. The method according to claim 23, further comprising injecting water into the downhole burner and cooling the liner with the water.

26. The method according to claim 23, wherein the steam has a steam quality of approximately 80% to 100% formed at the surface of the well that is fluidly communicated to the steam channel at a pressure of about 1600 psi.

27. The method according to claim 26, wherein the steam arriving at the steam channel has a steam quality of about 70% to 90%, and wherein approximately 37.5% of the steam provided through the steam channel is injected into the liner by the effusion cooling section.

28. The method according to claim 23, wherein the downhole burner has a power output of approximately 13 MMBtu/hr for producing about 3200 bpd of superheated steam with an outlet temperature of about 700° F.

29. The method according to claim 23, wherein the injector comprises an injector face plate having a plurality of injection holes for injecting the fuel and oxidizer into the burner, the injector face plate also having an igniter for igniting the fuel and oxidizer injected into the burner.

30. The method according to claim 29, wherein the injector face plate has fuel holes and oxidizer holes, each of which is arranged in concentric rings to produce a shower head stream pattern of fuel and oxidizer to move streams of the fuel and oxidizer away from the injector face plate, such that a standoff distance is provided between a flame of the combusted fuel and oxidizer and the injector face plate.

31. The method according to claim 23, further comprising injecting a nanocatalyst into the oil-bearing formation to promote converting and upgrading the hydrocarbon downhole.

32. The method according to claim 23, wherein the injector comprises (a) a cover plate having an oxidizer inlet, (b) an oxidizer distribution manifold plate having an oxidizer manifold and oxidizer holes coupled to the oxidizer inlet, and (c) a fuel distribution manifold plate having oxidizer holes, a fuel inlet, a fuel manifold for routing fuel through an interior of the fuel distribution manifold plate for cooling the fuel distribution plate, and fuel holes.

33. The method according to claim 23, wherein the well comprises a wellbore configuration selected from the group consisting of vertical, horizontal, SAGD, and combinations thereof.

34. The method according to claim 23, further comprising a separate $CO_2$ conduit for injecting $CO_2$ into at least one location of the downhole burner, including the injector, a head end of the liner, through the liner, and at an exit of the liner prior to a packer in the casing.

35. The method of claim 23, further comprising delivering a coolant to the downhole burner and cooling at least one of the injector and the liner using the coolant, wherein the coolant includes one of a gaseous phase coolant and liquid water.

36. The method of claim 23, wherein the well into which the downhole burner is lowered includes one of a well located beneath tundra, a land-based well, and a well located beneath a sea.

37. The method of claim 23, wherein the fuel includes one of hydrogen, natural gas, syngas, and combinations thereof.

38. The method of claim 23, wherein the oxidizer includes one of oxygen, air, oxygen-rich air, and combinations thereof.

39. A system for producing viscous hydrocarbons from a well having a casing, comprising:

a plurality of conduits for delivering fuel, an oxidizer, $CO_2$ and steam from a surface down through the casing;

a downhole burner secured to the plurality of conduits, the downhole burner comprising:

a burner casing;

an injector coupled to the plurality of conduits for injecting the fuel, oxidizer and $CO_2$ into the well;

a liner coupled to the burner casing located below the injector for combusting the fuel and oxidizer and releasing exhaust gases including the $CO_2$, wherein the liner includes an effusion cooling and jet mixing section having a plurality of effusion holes and a plurality of mixing holes, the mixing holes being larger than the effusion holes and oriented at a 90 degree angle relative to an internal surface of the liner to inject steam into the liner; and a steam channel located inside the burner casing and surrounding exterior surfaces of the injector and the liner.

40. The system according to claim 39, wherein the liner comprises an effusion cooling section located adjacent to the injector, and the effusion cooling and jet mixing section is located adjacent to the effusion cooling section.

41. The system according to claim 40, wherein the effusion cooling section has a plurality of effusion holes that inject small jets of steam through the liner to provide a layer of cooler gases to protect the liner, and the effusion holes extend through the liner at a 20 degree angle relative to the longitudinal axis of the liner and are oriented to inject steam downstream of the injector, such that the injected steam moves along an interior wall of the liner to lower a temperature thereof.

42. The system according to claim 39, wherein the injector comprises an injector face plate having a plurality of injection holes for injecting the fuel and oxidizer into the burner, the injector face plate also having an igniter for igniting the fuel and oxidizer injected into the burner, the burner casing and the liner each have a wall thickness of about 0.125 inches, the steam channel has an annular width between the liner and the burner casing of about 0.375 inches.

43. The system according to claim 42, wherein the injector face plate has fuel holes and oxidizer holes, each of which is arranged in concentric rings to produce a shower head stream pattern of fuel and oxidizer to move streams of the fuel and oxidizer away from the injector face plate, such that a standoff distance is provided between a flame of the combusted fuel and oxidizer and the injector face plate.

44. The system according to claim 39, wherein the injector comprises (a) a cover plate having an oxidizer inlet, the cover plate is located on (b) an oxidizer distribution manifold plate having an oxidizer manifold and oxidizer holes coupled to the oxidizer inlet, and the oxidizer distribution manifold plate is on top of (c) a fuel distribution manifold plate having oxidizer holes, a fuel inlet, a fuel manifold for routing fuel through an interior of the fuel distribution manifold plate for cooling the fuel distribution plate, and fuel holes, and the fuel distribution manifold plate is located on top of (d) an injector face plate.

45. The system of claim 39, wherein the $CO_2$ is delivered in the same conduit as at least one of the fuel and the oxidizer.

46. A downhole burner for a well, comprising:

a burner casing;

a liner coupled to the burner casing for combusting a fuel and an oxidizer;

an injector coupled to the liner for injecting the fuel and the oxidizer into the liner, wherein the injector comprises:

a cover plate having an oxidizer inlet;

an oxidizer distribution manifold plate having an oxidizer manifold and oxidizer holes in fluid communication with the oxidizer inlet;

a fuel distribution manifold plate having oxidizer holes in fluid communication with the oxidizer holes of the oxidizer distribution manifold plate, a fuel inlet, a fuel manifold for routing fuel from the fuel inlet through an interior of the fuel distribution manifold plate for cooling the fuel distribution manifold plate, and fuel holes in fluid communication with the fuel inlet; and an injector face plate having oxidizer holes in fluid communication with the oxidizer holes of the fuel distribution manifold plate and fuel holes in fluid communication with the fuel holes of the fuel distribution manifold plate; and a steam channel located inside the burner casing and surrounding the injector and the liner, wherein the liner includes a plurality of holes for communicating steam from the steam channel to an interior of the liner downstream from the injector.

47. The downhole burner of claim 46, wherein the cover plate is located on top of the oxidizer distribution manifold, wherein the oxidizer distribution manifold is located on top of the fuel distribution manifold plate, wherein the fuel distribution manifold plate is located on top of the injector face plate.

48. The downhole burner of claim 46, wherein the cover plate, the oxidizer distribution manifold plate, the fuel distribution manifold plate, and the injector face plate are in a stacked configuration.

49. The downhole burner of claim 46, wherein the injector is positioned at an upper end of the liner.

50. A system for producing hydrocarbons from a well, comprising:

a plurality of conduits for delivering a fuel, an oxidizer, and steam from a surface of the well; and a downhole burner secured to the plurality of conduits, the downhole burner comprising:

a burner casing;

an injector coupled to the plurality of conduits for injecting the fuel and the oxidizer into the well;

a liner coupled to the burner casing, wherein the fuel and the oxidizer are combusted within the liner; and a steam channel located inside the burner casing and surrounding exterior surfaces of the injector and the liner, wherein the liner includes:

a first section having a plurality of holes disposed through the liner at a first angle for communicating steam from the steam channel to an interior of the liner; and a second section having a second plurality of holes that are larger than the first plurality of holes and are disposed through the liner at a second angle different than the first angle for communicating steam from the steam channel to the interior of the liner and a third plurality of holes disposed through the liner at a third angle different than the second angle for communicating steam from the steam channel to the interior of the liner, wherein the first section is located above the second section and adjacent to the injector.

* * * * *

UNITED STATES PATENT AND TRADEMARK OFFICE

CERTIFICATE OF CORRECTION

PATENT NO. : 7,770,646 B2
APPLICATION NO. : 11/868707
DATED : August 10, 2010
INVENTOR(S) : Klassen et al.

It is certified that error appears in the above-identified patent and that said Letters Patent is hereby corrected as shown below:

In the Background of the Invention:

Column 1, Line 23, please delete "males" and insert --makes-- therefor.

Signed and Sealed this

Thirtieth Day of November, 2010

David J. Kappos

David J. Kappos
*Director of the United States Patent and Trademark Office*